US012129644B2

(12) United States Patent
Lai

(10) Patent No.: US 12,129,644 B2
(45) Date of Patent: Oct. 29, 2024

(54) MODULAR CONNECTION DEVICE

(71) Applicant: Hsiang Wei Lai, Changhua County (TW)

(72) Inventor: Hsiang Wei Lai, Changhua County (TW)

( * ) Notice: Subject to any disclaimer, the term of this patent is extended or adjusted under 35 U.S.C. 154(b) by 459 days.

(21) Appl. No.: 17/464,680

(22) Filed: Sep. 2, 2021

(65) Prior Publication Data

US 2022/0074191 A1 Mar. 10, 2022

(30) Foreign Application Priority Data

Sep. 4, 2020 (TW) ..... 109130498

(51) Int. Cl.
*E04B 1/19* (2006.01)

(52) U.S. Cl.
CPC .... *E04B 1/1903* (2013.01); *E04B 2001/1933* (2013.01); *E04B 2001/196* (2013.01)

(58) Field of Classification Search
CPC .. F16B 7/18; F16B 7/185; F16B 12/50; A47B 47/0016; E04B 2001/1966; E04B 2001/1924; E04B 2001/1927; E04B 1/1906; E04B 1/1909; E04B 1/1912
See application file for complete search history.

(56) References Cited

U.S. PATENT DOCUMENTS 3,864,051 A * 2/1975 Reid ..... F16B 7/0446 411/180
3,890,022 A * 6/1975 Moon ..... A47B 47/0008 403/171
3,901,613 A * 8/1975 Andersson ..... F16B 7/0446 403/174
3,912,410 A * 10/1975 Pofferi ..... F16B 7/04 403/219
4,012,153 A * 3/1977 Pidgeon ..... F16B 7/185 403/231
4,072,432 A * 2/1978 Levy ..... F16B 7/0446 403/176
4,082,470 A * 4/1978 Alberts ..... A47B 47/0016 403/295
4,271,654 A * 6/1981 Jungbluth ..... E04B 1/1912 52/655.1
4,780,018 A * 10/1988 Godden ..... E04B 1/1906 403/292
4,789,264 A * 12/1988 Galan Inchaurbe .. E04B 1/1906 403/171
4,796,389 A * 1/1989 Bini ..... E04B 7/105 52/63
4,806,041 A * 2/1989 Chamayou dit Felix ..... E04B 1/1906 403/171
4,915,533 A * 4/1990 de la Haye ..... E04B 1/1906 403/171
5,062,732 A * 11/1991 Ballerstein ..... E04F 11/1817 256/65.1

(Continued)

*Primary Examiner* — Daniel J Wiley
(74) *Attorney, Agent, or Firm* — Bruce Stone LLP; Joseph A. Bruce

(57) ABSTRACT

A modular connection device is provided. The modular connection device includes a base and a plurality of connection members. The base includes a plurality of connection surfaces, wherein each of the connection surfaces is connected with each other. Each of the connection members is detachably connected on each of the connection surfaces.

13 Claims, 15 Drawing Sheets

(56) References Cited

U.S. PATENT DOCUMENTS

| | | | | |
|---|---|---|---|---|
| 5,141,351 | A * | 8/1992 | Imai | E04B 1/1912 403/171 |
| 5,580,181 | A * | 12/1996 | Nomura | A47B 47/0016 403/231 |
| 6,881,005 | B2 * | 4/2005 | Sosa | F16B 7/18 403/395 |
| 6,887,009 | B1 * | 5/2005 | Lopez | E04B 1/19 403/171 |
| 2004/0120759 | A1 * | 6/2004 | Altman | F16B 7/185 403/374.3 |
| 2004/0245513 | A1 * | 12/2004 | Izumi | E04F 11/1834 256/65.02 |
| 2011/0095527 | A1 * | 4/2011 | Miyoshi | F16B 7/185 285/334.1 |
| 2011/0194892 | A1 * | 8/2011 | Huang | F16B 12/50 403/296 |
| 2012/0301215 | A1 * | 11/2012 | Huang | A47B 47/0016 403/176 |
| 2013/0098186 | A1 * | 4/2013 | Bernardin | A47B 47/0008 74/89.34 |
| 2014/0241794 | A1 * | 8/2014 | Sim | F16B 7/20 403/349 |
| 2015/0377414 | A1 * | 12/2015 | Pirseyedi | F16B 7/0466 403/205 |
| 2019/0249700 | A1 * | 8/2019 | Deng | F16B 7/22 |

* cited by examiner

MODULAR CONNECTION DEVICE

RELATED APPLICATIONS

This application claims priority to Taiwan Application Serial No. 109130498, filed Sep. 4, 2020 which is herein incorporated by reference.

BACKGROUND

Technical Field

The present disclosure relates to a connection device. More particularly, the present disclosure relates to a modular connection device being capable of forming a skeleton.

Description of Related Art

Many products require skeletons to form a basic supporting structure. Furnitures such as sofas, sofa chairs, coffee tables, corner tables, TV cabinets, wine cabinets, decorative cabinets, shoe cabinets, wardrobes, bedside cabinets, dressing tables, hangers, cabinets, dining tables, dining chairs, sideboards, corner cabinets, hand-waste baskets, bookshelves, desks, chairs, file cabinets and umbrella racks all require skeletons. More broadly speaking, skeletons can also be seen in doors, windows, bicycles, motorcycles and automobiles, etc.

In the early days, most of the above-mentioned equipment was made in one piece, therefore the required procedures were complicated and the manufacturing cost was also high. In the later period, the demand for self-assembly by individuals is gradually flourished, and products having capability of assembling/disassembling the components thereof appeared on the market. However, due to the complexity of the structure and the usage pattern, not all products are suitable for assembling/disassembling its components. Furthermore, the products on the market that can be self-assembled/disassembled still have limitations in application, and often still require cumbersome assembly/disassembly processes. Therefore, it is still necessary to develop products with low manufacturing cost, high flexibility of use, wide application range and meeting the needs of self-assembly/disassembly.

SUMMARY

According to one aspect of the present disclosure, a modular connection device is provided. The modular connection device includes a base and a plurality of connection members. The base includes a plurality of connection surfaces, wherein each of the connection surfaces is connected with each other. Each of the connection members is detachably connected on each of the connection surfaces.

In some embodiments, each of the connection surfaces can be a planar surface or a curved surface.

In some embodiments, each of the connection members can be detachably inserted into each of the connection surfaces.

In some embodiments, an angle is formed between an axis of each of the connection members and each of the connection surfaces.

In some embodiments, the angle is greater than 0 degrees and smaller than 180 degrees.

In some embodiments, each of the connection member can be a solid pillar or a hollow pillar.

In some embodiments, each of the connection member can be curve-shaped, straight-shaped or arc-shaped.

In some embodiments, the modular connection device further includes a pivot member. The pivot member is detachably disposed between the base and another base, and the two bases are rotatable with each other through the pivot member.

In some embodiments, the modular connection device further includes a pivot member. The pivot member is detachably disposed between the base and the connection member, and the base and the connection member are rotatable with each other through the pivot member.

According to another aspect of the present disclosure, a modular connection device is provided. The modular connection device includes a base, a plurality of adapting members and a plurality of connection members. The base includes a plurality of connection surfaces, and each of the connection surfaces is connected with each other. Each of the adapting members is detachably connected on each of the connection surfaces. Each of the connection members is detachably connected on each of the connection surfaces through each of the adapting members.

In some embodiments, each of the connection surfaces can be a planar surface or a curved surface.

In some embodiments, each of the adapting members can be detachably inserted to each of the connection surfaces.

In some embodiments, each of the connection member can be covered on each of the adapting member.

In some embodiments, each of the connection member can be a solid pillar or a hollow pillar.

In some embodiments, each of the connection member can be curve-shaped, straight-shaped or arc-shaped.

In some embodiments, each of the adapting member can include a curved portion.

In some embodiments, the modular connection device further includes a pivot member. The pivot member is detachably disposed between the base and another base, and the two bases are rotatable relative to each other through the pivot member.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
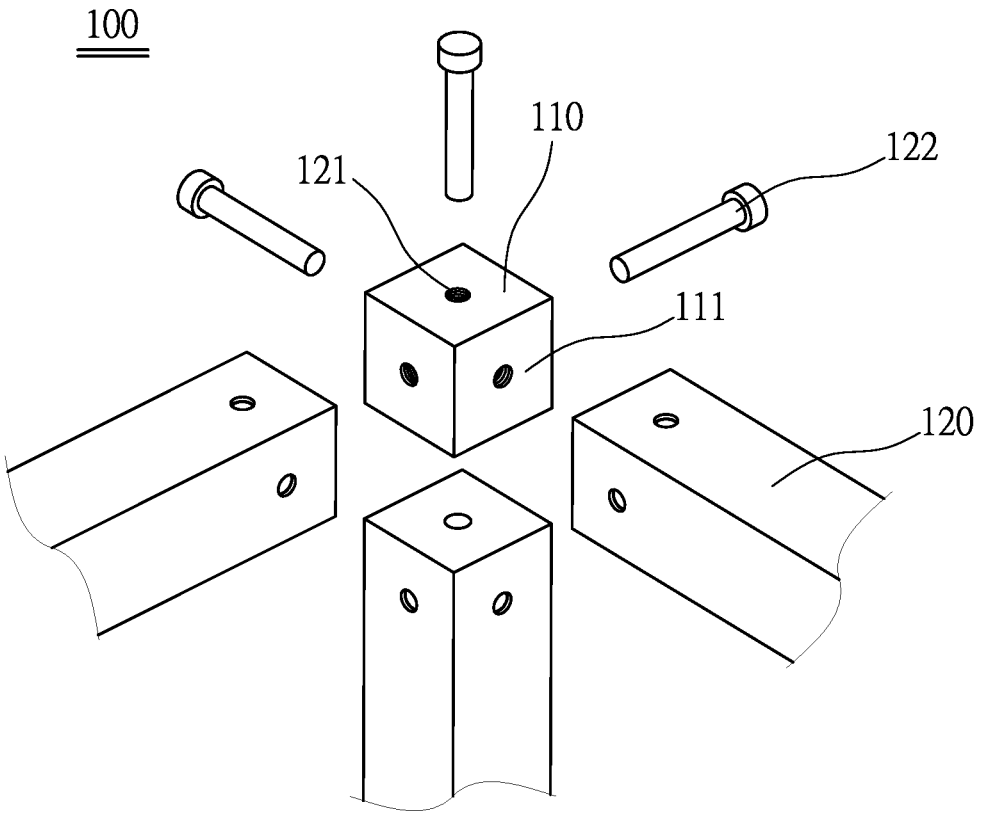
FIG. 1 is a schematic diagram showing a modular connection device according to one embodiment of the present disclosure.

FIG. 1 is a schematic diagram showing a modular connection device 100 according to one embodiment of the present disclosure. The modular connection device 100 includes a base 110 and a plurality of connection members 120. The base 110 includes a plurality of connection surfaces 111, and each of the connection surfaces 111 is connected with each other. Each of the connection members 120 is detachably connected on each of the connection surfaces 111. In FIG. 1, each of the connection surfaces 111 is a planar surface and is connectable with each of the connection member 120. Screw holes 121 can be opened on the base 110 and each of the connection members 120. Screws 122 can be used to screw each of the connection members 120 on the base 110 through the screw holes 121, thereby strengthening the connection between the base 110 and the connection members 120.

Figure 2A:
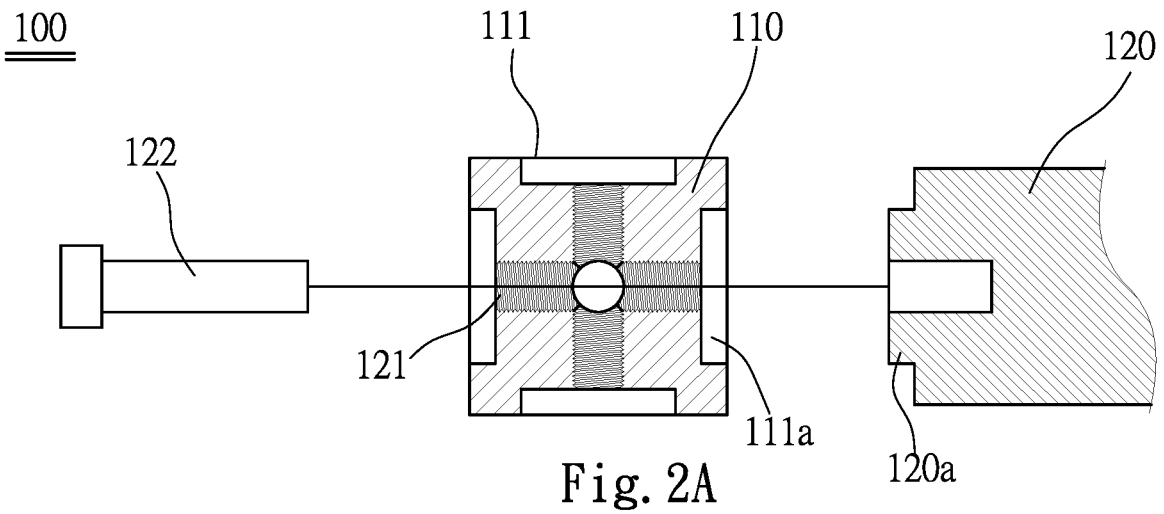
FIG. 2A is a schematic diagram showing a first connection structure of the base and the connection member in FIG. 1.
Figure 2B:
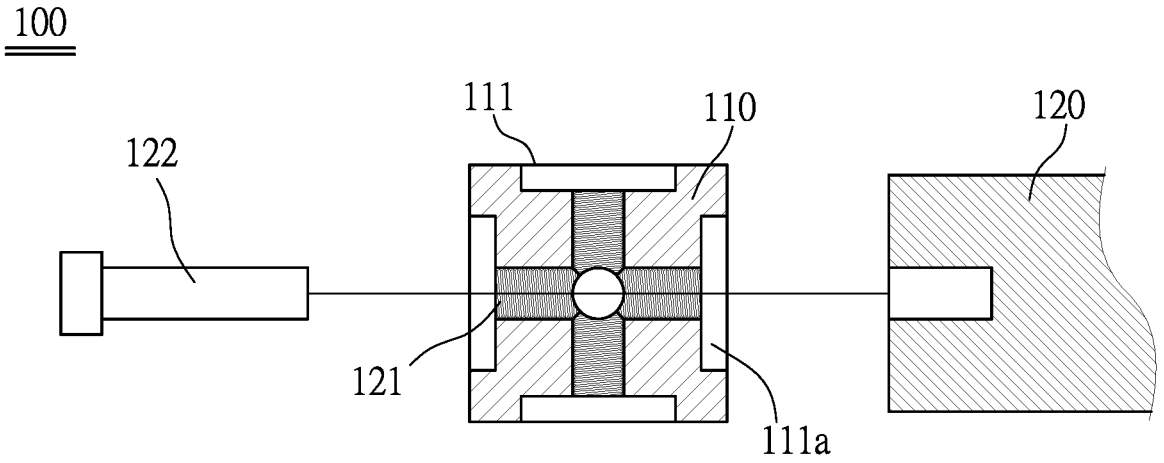
FIG. 2B is a schematic diagram showing a second connection structure of the base and the connection member in FIG. 1.
Figure 2C:
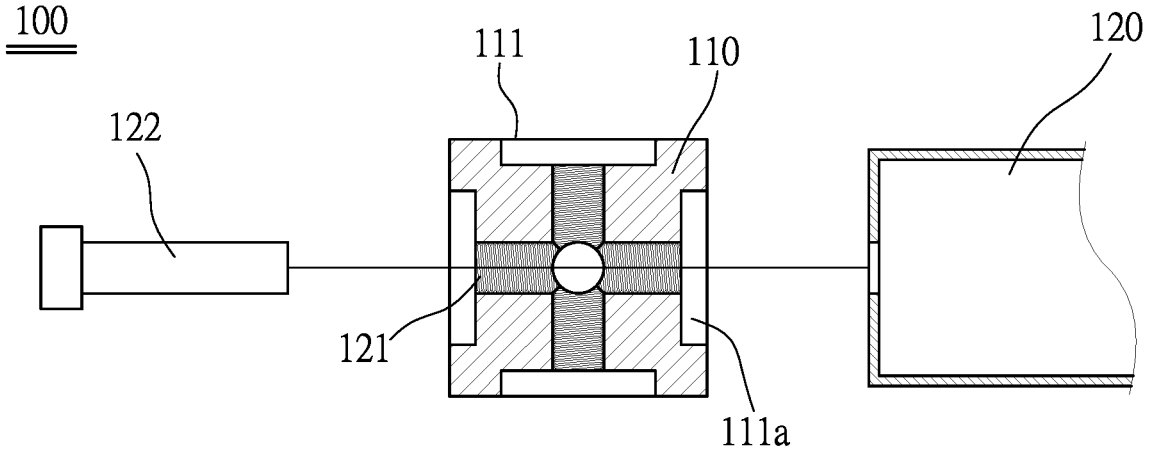
FIG. 2C is a schematic diagram showing a third connection structure of the base and the connection member in FIG. 1.

FIGS. 2A, 2B and 2C show various connection structures of the base 110 and the connection member 120 in FIG. 1. In FIG. 2A, the connection surface 111 of the base 110 includes a concave portion 111*a*, and one end of the connection member 120 includes a convex portion 120*a*, therefore the connection member 120 can be detachably inserted into the concave portion 111*a* of the base 110 by using the convex portion 120*a* thereof. Screws 122 can be used to screw the base 110 and the connection members 120 through the screw holes 121. In FIG. 2B, the surface of the base 110 that connected with the connection member 120 is a planar surface, and the screw 122 can be used to screw the base 110 and the connection members 120 through the screw holes 121 on both the base 110 and the connection member 120. In FIG. 2C, the surface of the base 110 that connected with the connection member 120 is a planar surface, and the connection member 120 is a hollow pillar. Similarly, screws 122 can also be used to screw the base 110 and the connection members 120. In FIGS. 2A and 2B, the connection member 120 is a solid pillar, and in FIG. 2C, the connection member 120 is a hollow pillar. Therefore, in the present disclosure, the structure of the connection member 120 can be varied with different application ranges.

Figure 3A:
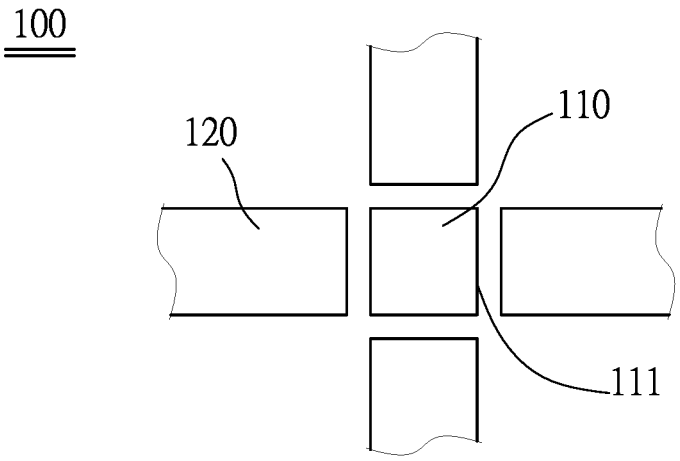
FIG. 3A is a schematic diagram showing a first structure of the base in FIG. 1.
Figure 3B:
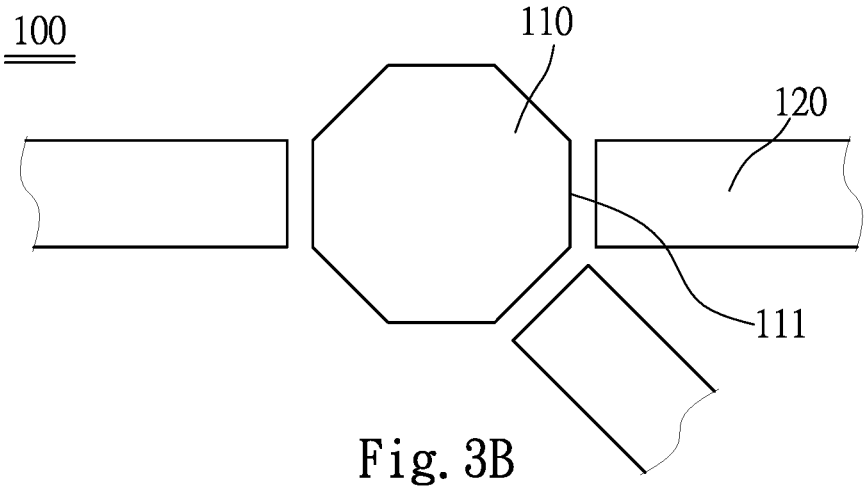
FIG. 3B is a schematic diagram showing a second structure of the base in FIG. 1.
Figure 3C:
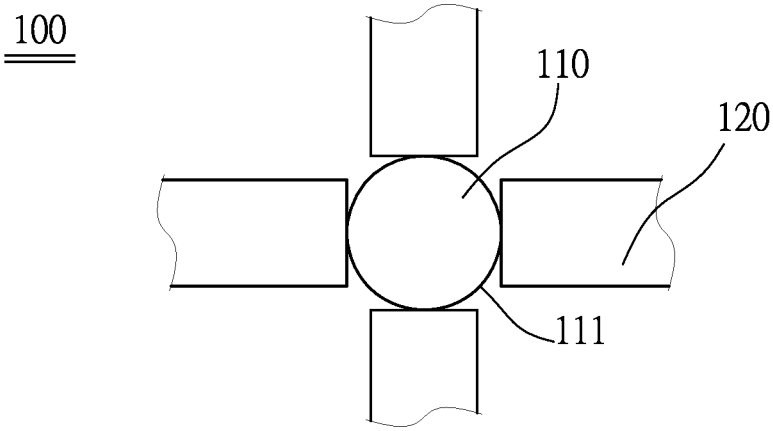
FIG. 3C is a schematic diagram showing a third structure of the base in FIG. 1.

FIGS. 3A, 3B and 3C show various structure of the base 110 and the connection member 120 in FIG. 1. In FIG. 3A, the base 110 is a cube and has six connection surfaces 111. The connection member 120 can be connected on the six connection surfaces 111 of the base 110. In FIG. 3B, the base 110 is a polyhedron, and one of the surfaces is octagonal. Therefore, the base 110 in FIG. 3B has ten connection surfaces 111 which is connectable with the connection members 120. Therefore, the base 110 in FIG. 3B has more connection angle variations, and more complicated structure can be obtained. In FIG. 3C, the base 110 is a sphere, thus the connection surface 111 thereof is a curved surface. The base 110 in FIG. 3C can have more continuous angle variations.

Figure 4A:
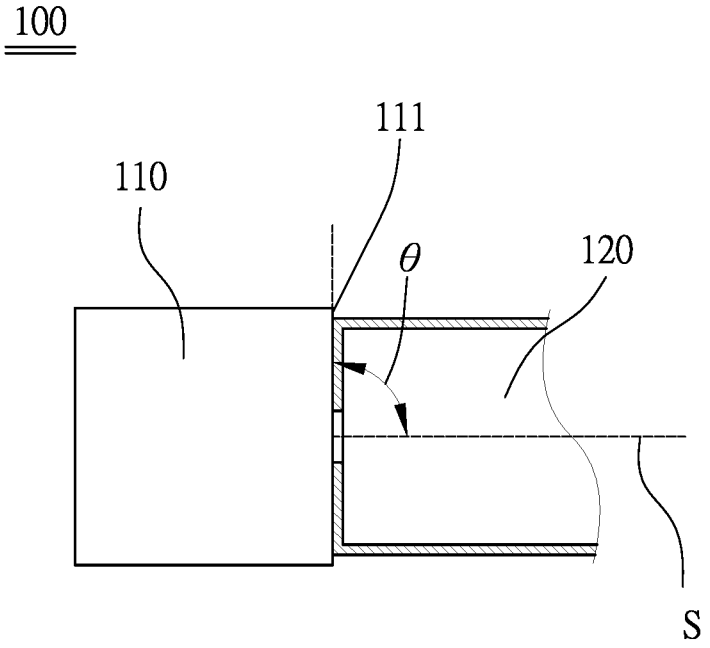
FIG. 4A is a schematic diagram showing an angle formed between the base and the connection member.
Figure 4B:
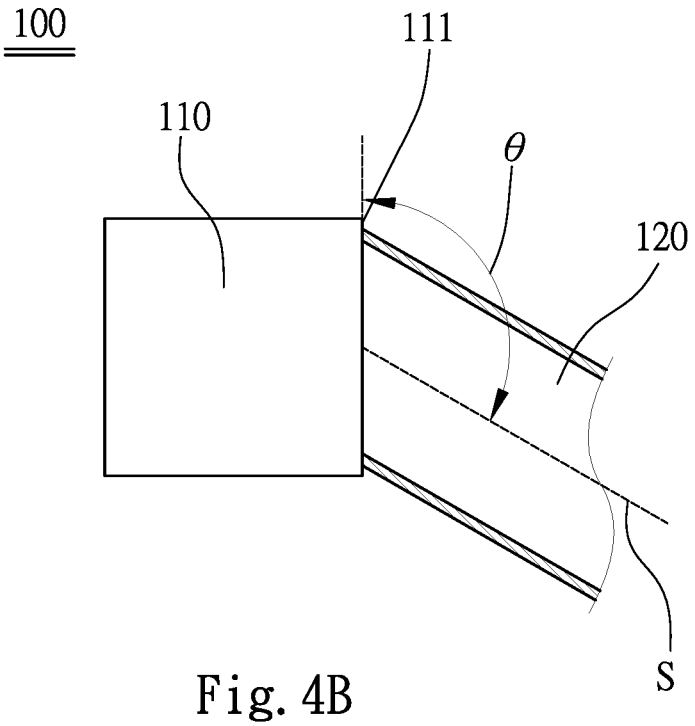
FIG. 4B is a schematic diagram showing another angle formed between the base and the connection member.

FIG. 4A is a schematic diagram showing an angle θ formed between the base 110 and the connection member 120. FIG. 4B is a schematic diagram showing another angle θ formed between the base 110 and the connection member 120. In some embodiments, the connection member 120 cab be curve-shaped, straight-shaped or arc-shaped, and an angle θ is formed between an axis S of the connection members 120 and the connection surface 111 of the base 110. The angle θ can be greater than 0 degrees and smaller than 180 degrees. In FIG. 4, the angle θ between the axis S of the connection member 120 and the connection surface 111 is 90 degrees. In FIG. 4B, the connection member 120 is inclined obliquely, thus the angle θ between the axis S of the connection member 120 and the connection surface 111 is 135 degrees. The angle θ may be varied between 0 degrees and 90 degrees with different inclining direction of the connection member 120 (e.g., inclined diagonally upward).

Figure 5A:
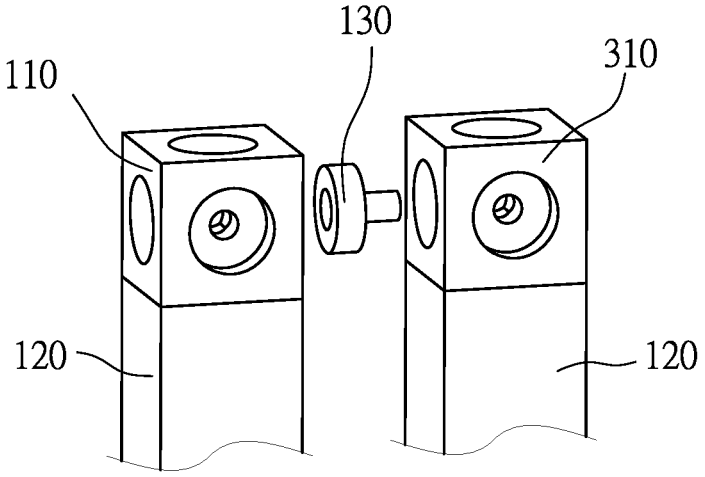
FIG. 5A is a schematic diagram showing an application of the modular connection device of FIG. 1.
Figure 5B:
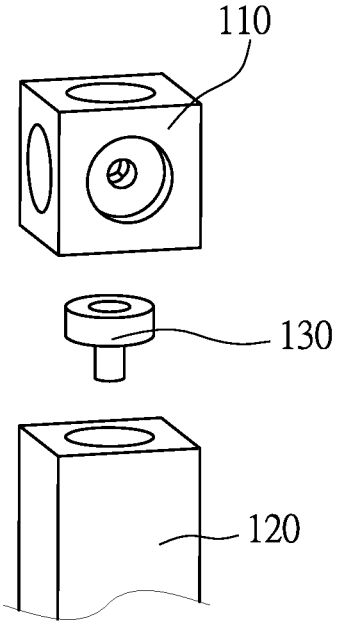
FIG. 5B is a schematic diagram showing another application of the modular connection device in FIG. 1.

FIG. 5A is a schematic diagram showing an application of the modular connection device 100 of FIG. 1. FIG. 5B is a schematic diagram showing another application of the modular connection device 100 in FIG. 1. In FIG. 5A, a detachable pivot member 130 is disposed between the base 110 and another base 310. In some embodiments, one end of the pivot member 130 is rotatably disposed on one surface of the base 310. Therefore, the base 110 can rotate relative to the pivot member 130, and the base 310 also can rotate relative to the pivot member 130. Thus, the base 110 can rotate relative to the base 310 for forming a required angle. Similarly, in FIG. 5B, the pivot member 130 can also be disposed between the base 110 and the connection member 120, and the base 110 can rotate relative to the connection member 120 through the pivot member 130.

Figure 6:
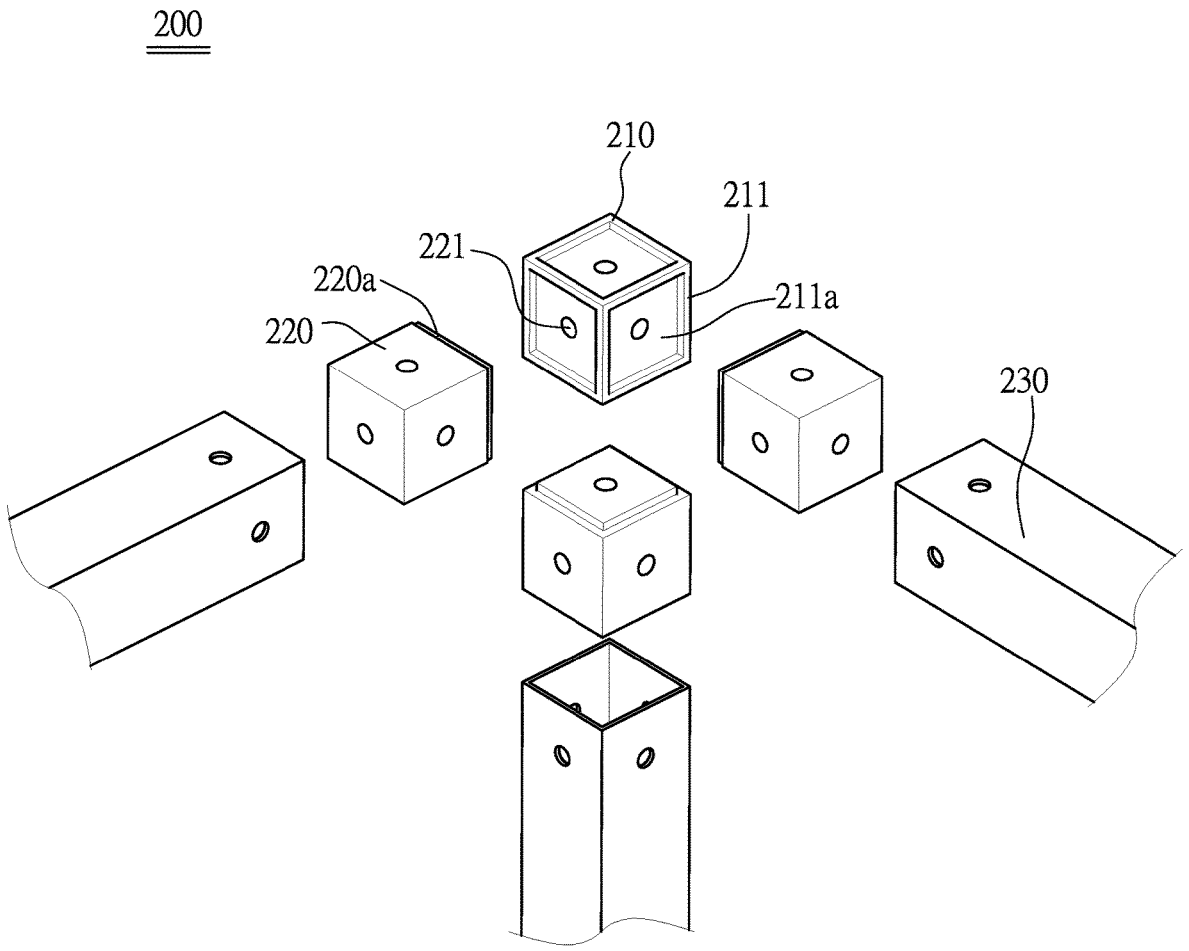
FIG. 6 is a schematic diagram showing a modular connection device according to another embodiment of the present disclosure.
Figure 7:
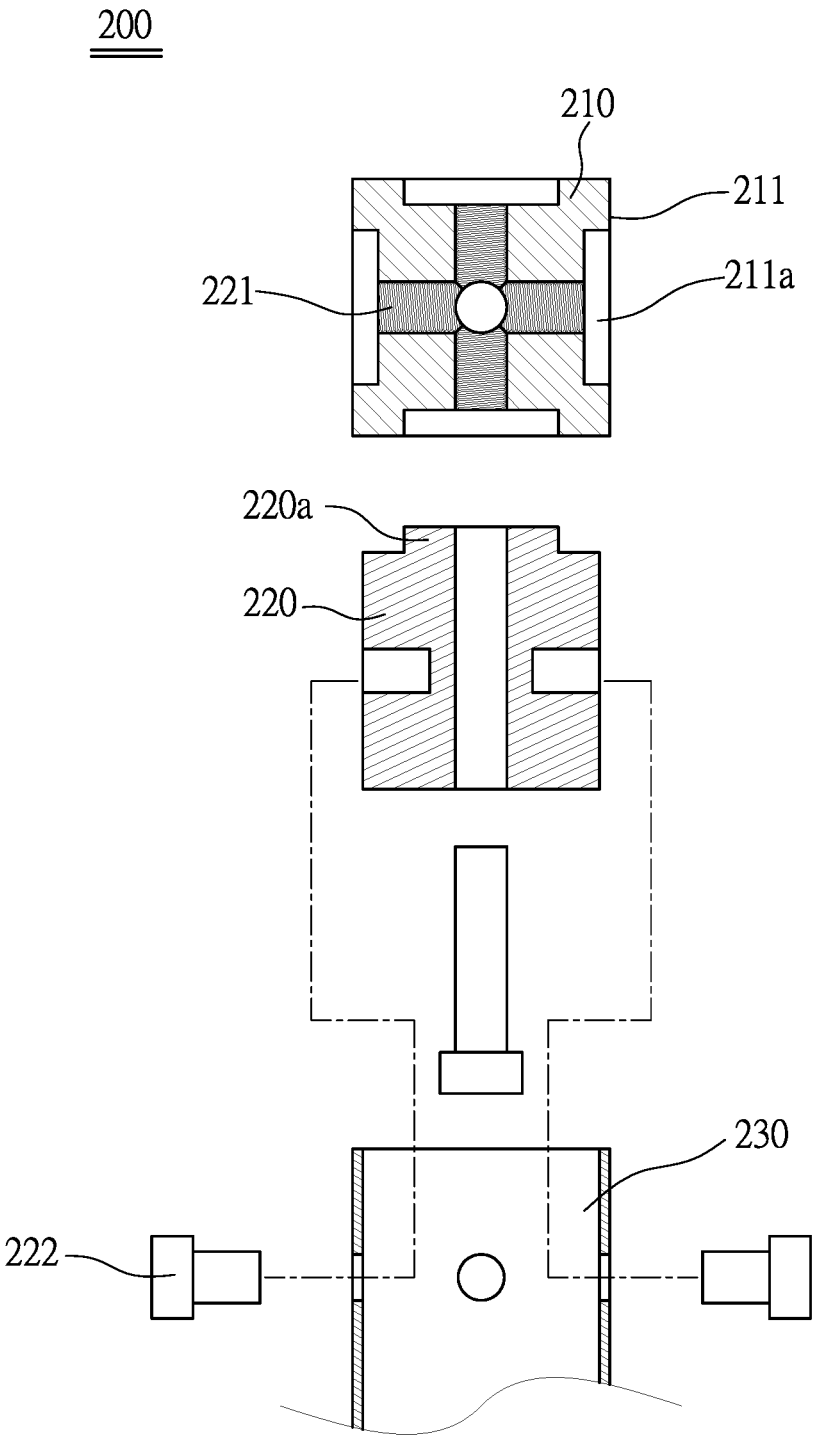
FIG. 7 is a schematic diagram showing a connection structure between the base, the adapting member and the connection member in FIG. 6.

FIG. 6 is a schematic diagram showing a modular connection device 200 according to another embodiment of the present disclosure. FIG. 7 is a schematic diagram showing a connection structure between the base 210, the adapting member 220 and the connection member 230 in FIG. 6. The modular connection device 200 in FIG. 6 and the modular connection device 100 in FIG. 1 has similar structures. The difference is that in FIG. 6, an extra adapting member 220 is disposed between each of the connection surfaces 211 of the base 210 and each of the connection members 230. Each of the adapting members 220 is detachably connected on each of the connection surfaces 211; and each of the connection members 230 is detachably connected on each of the connection surfaces 211 through each of the adapting members 220. In FIG. 7, the connection surface 211 of the base 210 includes a concave portion 211*a*, and the adapting member 220 includes a convex portion 220*a*, therefore the adapting member 220 can be detachably inserted into the concave portion 211*a* of the base 210 by using the convex portion 220*a* thereof. Screws 222 can be used to screw the base 210 and the adapting members 220 through the screw holes 221 on the adapting members 220. The connection member 230 can be covered on the adapting member 220, or the connection member 230 can be screwed on the adapting member 220. From the appearance of the modular connection device 200, the base 210 and the connection member 230 are exposed, the adapting member 220 is hidden in connection member 230. Compared to the modular connection device 100 in FIG. 1, the modular connection device 200 in FIGS. 6 and 7 can have different modularized assembly by adding extra adapting members 220, thus wider application range can be achieved.

Figure 8A:
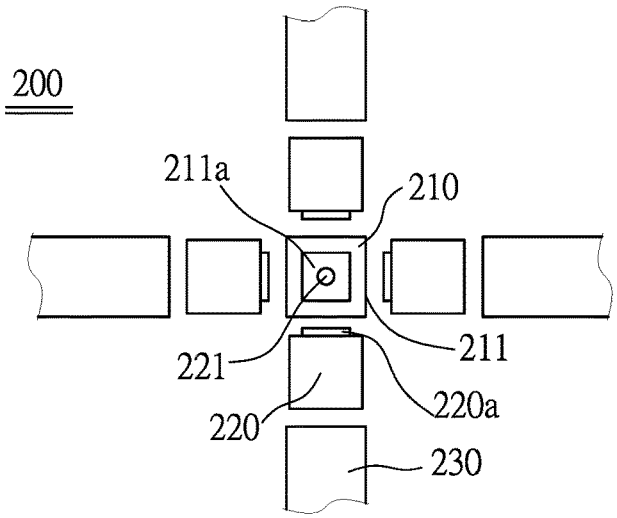
FIG. 8A is a schematic diagram showing a first structure of the base in FIG. 6.
Figure 8B:
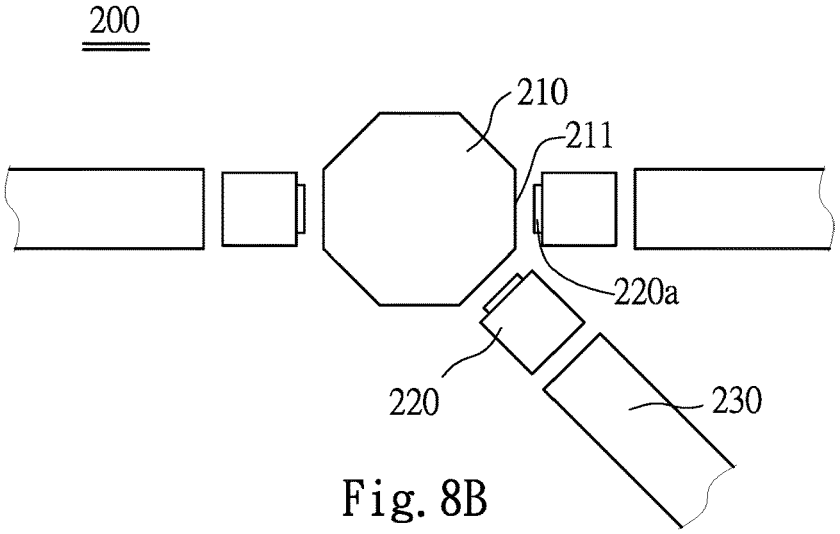
FIG. 8B is a schematic diagram showing a second structure of the base in FIG. 6.
Figure 8C:
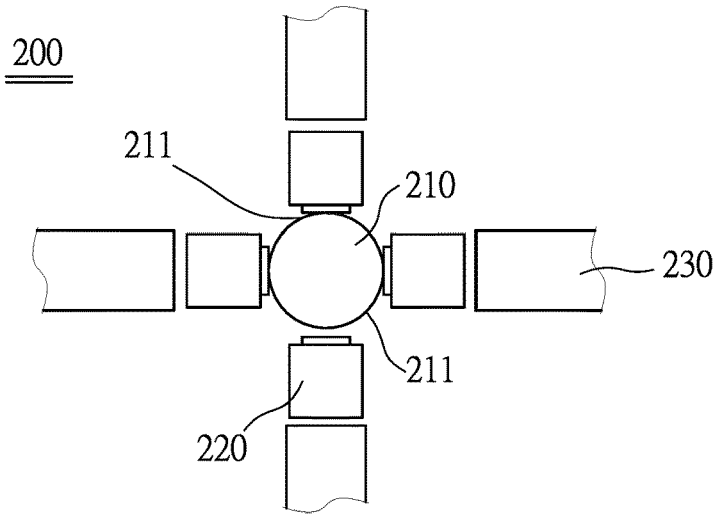
FIG. 8C is a schematic diagram showing a third structure of the base in FIG. 6.

FIG. 8A is a schematic diagram showing a first structure of the base 210 in FIG. 6. FIG. 8B is a schematic diagram showing a second structure of the base 210 in FIG. 6. FIG. 8C is a schematic diagram showing a third structure of the base 210 in FIG. 6. The base 210 in FIG. 6 can have different structure variations, thereby forming a cube as in FIG. 8A, a polyhedron as in FIG. 8B or a sphere as in FIG. 8C. Different form the devices in FIGS. 3A to 3C, in the modular connection devices 200 in FIGS. 8A to 8C, an extra adapting member 220 can be selectably disposed between the base 210 and the connection member 230, thus the application range can be extended.

Figure 9:
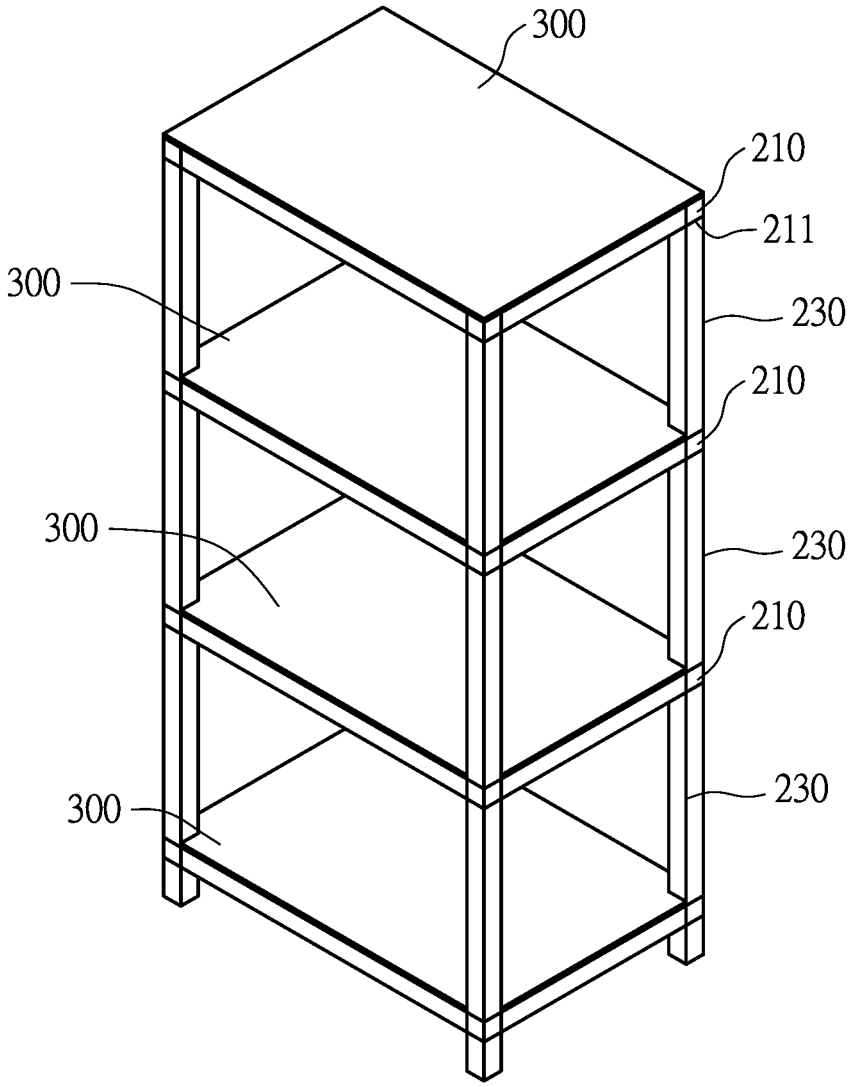
FIG. 9 is a schematic diagram showing a first application of the modular connection device of the present disclosure.
Figure 10:
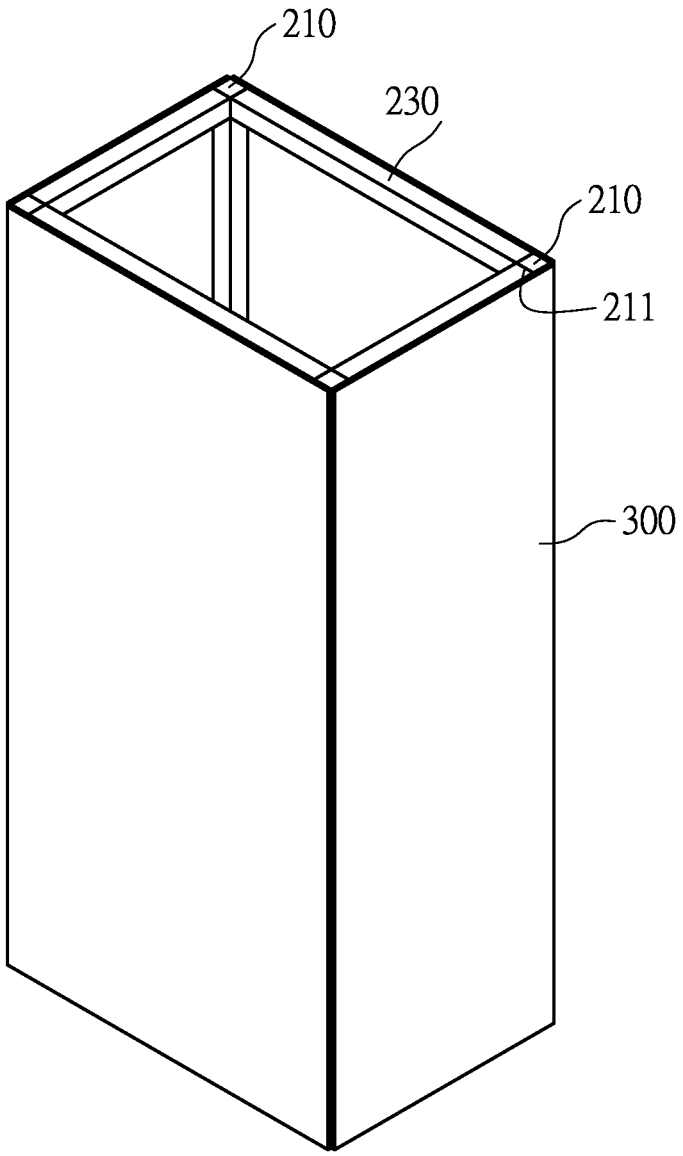
FIG. 10 is a schematic diagram showing a second application of the modular connection device of the present disclosure.
Figure 11:
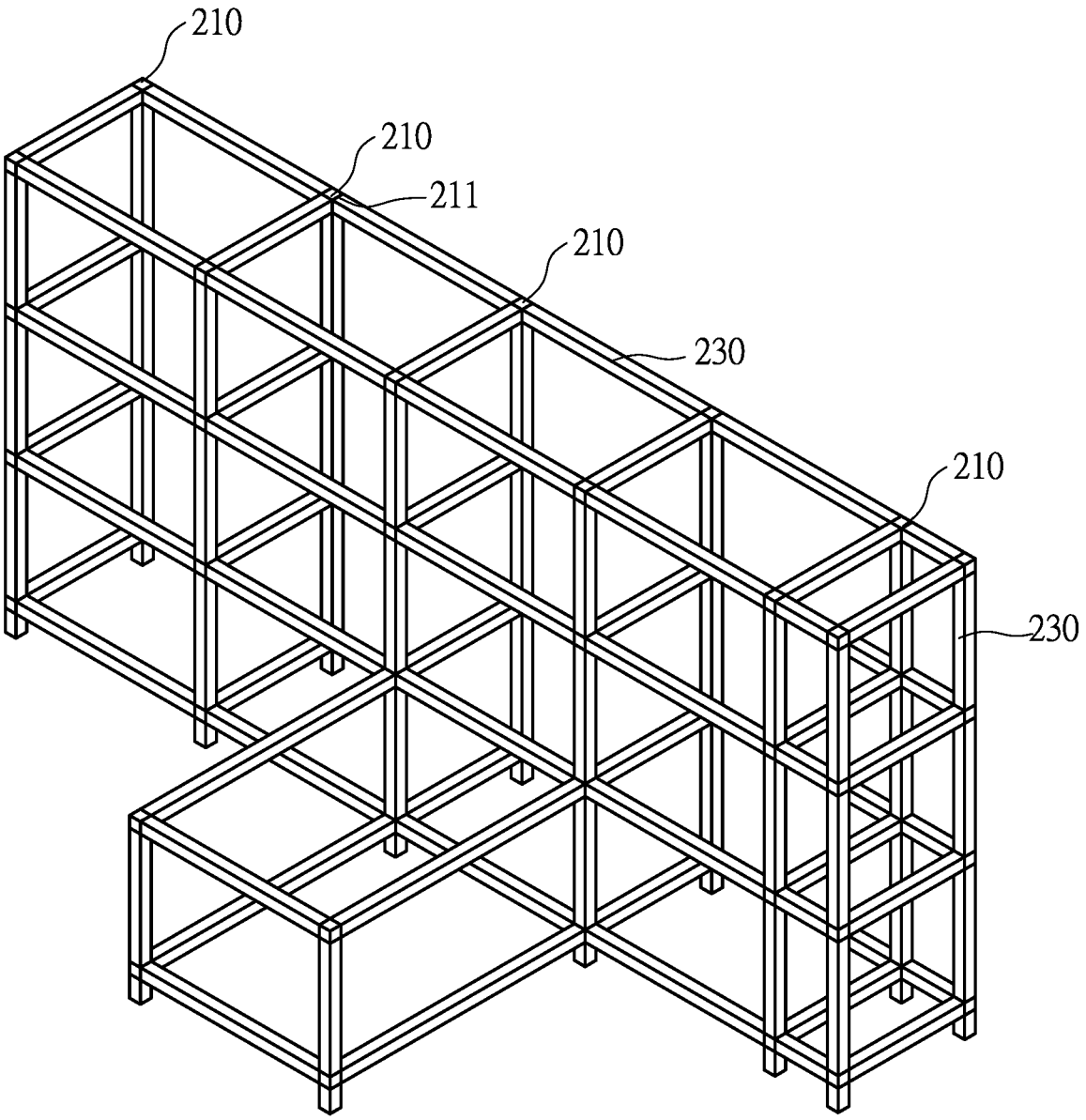
FIG. 11 is a schematic diagram showing a third application of the modular connection device of the present disclosure.
Figure 12:
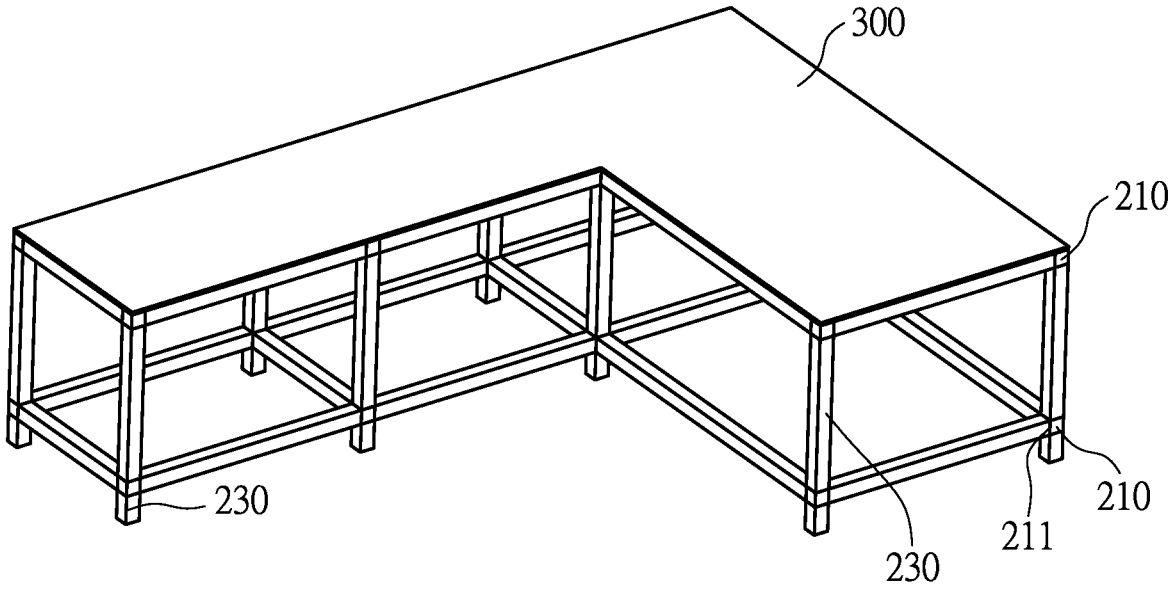
FIG. 12 is a schematic diagram showing a fourth application of the modular connection device of the present disclosure.
Figure 13:
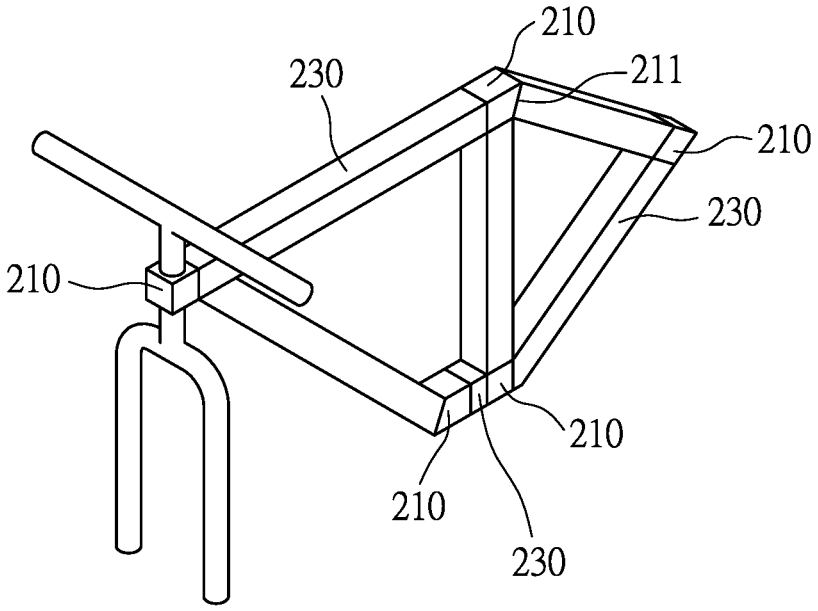
FIG. 13 is a schematic diagram showing a fifth application of the modular connection device of the present disclosure.
Figure 14:
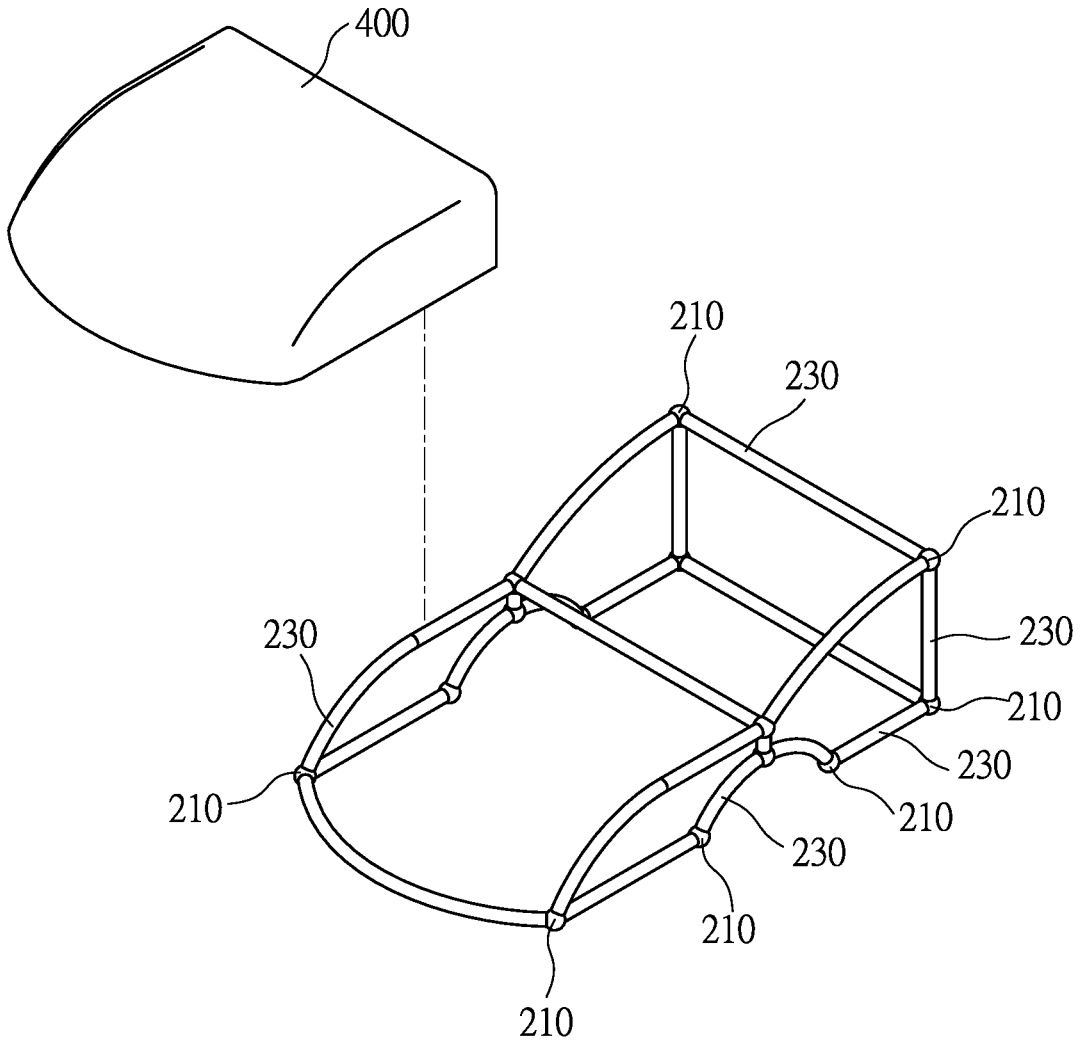
FIG. 14 is a schematic diagram showing a sixth application of the modular connection device of the present disclosure.

FIGS. 9, 10, 11, 12, 13 and 14 show six applications of the modular connection devices 200. In FIG. 9, the modular connection device 200 is connected repeatedly to form a skeleton of a storage platform. The base 210 has connection surfaces 211 with various directions and angles, which can be used for connecting with connection members 230, thus various geometry structures can be formed. After the final skeleton is formed by assembling proper quantities of the bases 210 and the connection members 230, a plate 300 can be laid on a horizontal surface formed by connecting the connection members 230. The plate 300 can be used for supporting objects. In FIG. 10, after the skeleton is formed, a plate 300 can be laid on a perpendicular surface formed by connecting the connection members 230, thus a bucket-liked structure can be formed. In FIG. 11, the base 210 has connection surfaces 211 having different directions and angles, therefore the connection members 230 can be extended toward different directions, and skeletons having different dimensions and shapes can be formed. In FIG. 12, after laying the plate 300, portions of the skeleton can be sealed, thus various structures such as storage seats, tables and chairs can be formed to make the device versatile. In FIGS. 13 and 14, the modular connection device 200 can be used to form more complicated skeleton structure (e.g., the skeleton of the vehicle). In FIG. 13, the base 210 of the modular connection device 200 is a polyhedron with inclined connection surfaces 211, and inclined connection members 230 are used to form a bike skeleton. In FIG. 14, curved connection members 230 are used to construct a skeleton of a car body. In another embodiment, adapting members 220 with curved portions can be used to make the connection members 230 to be connected to construct curved surfaces. Curved covers 400 can be used to cover the curved surfaces to construct the vehicle body. Therefore, in the modular connection device 200 of the present disclosure, the connection members 230 can directly connected with the base 210 or indirectly connected with the base 210 by utilizing the adapting members 220. Each part of the modular connection device 200 can be freely detached, the connection members 230 can be a solid pillar or a hollow pillar, and can be curve-shaped, straight-shaped or arc-shaped. In other word, the modular connection device 200 of the present disclosure can have various geometry shapes. The modular connection device 200 of the present disclosure also has high usability and flexibility owing to its modularization functionality.

Figure 15:
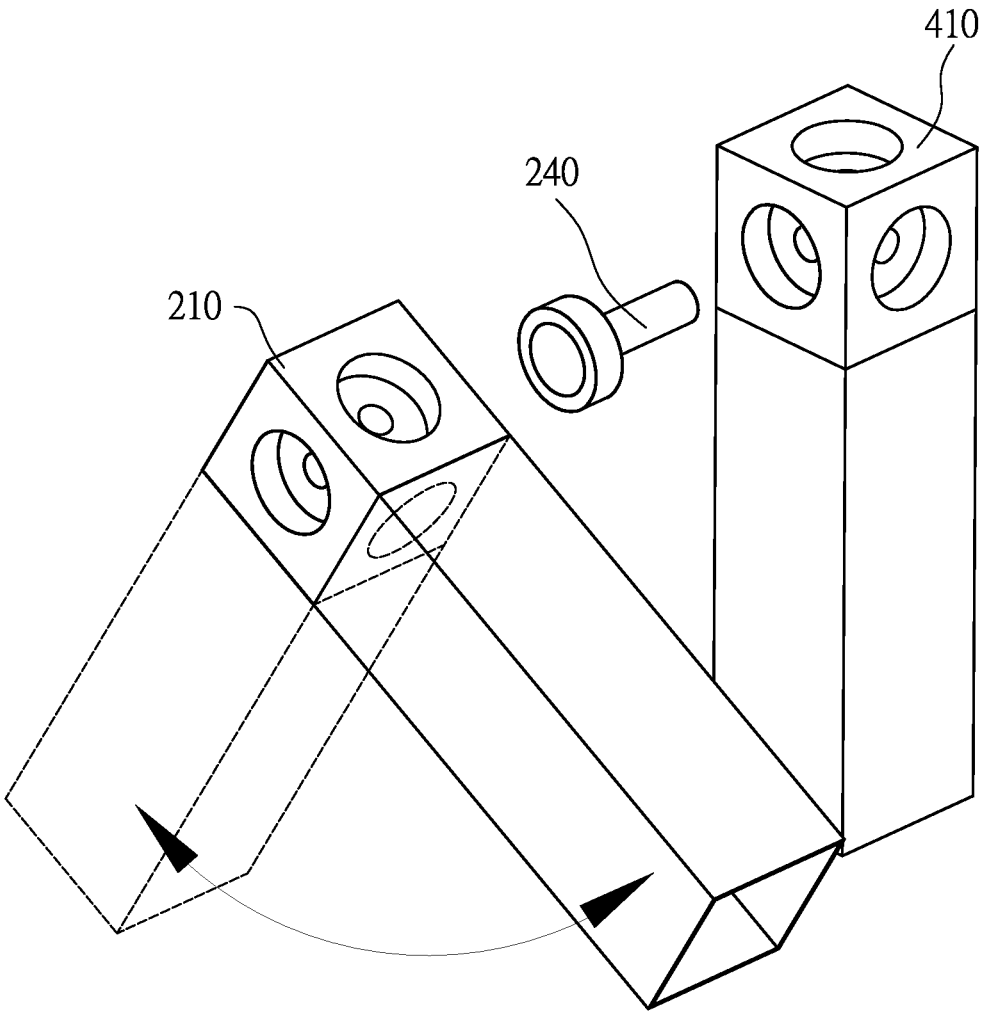
FIG. 15 is a schematic diagram showing a seventh application of the modular connection device of the present disclosure.

FIG. 15 is a schematic diagram showing a seventh application of the modular connection device 200 of the present disclosure. In FIG. 15, a pivot member 240 is disposed between the base 210 and another base 410. In one embodiment, one end of the pivot member 240 is rotatably disposed on surface of the base 210, and the other end of the pivot member 240 is rotatably disposed on one surface of the base 410. Therefore, the base 21 can rotate relative to the pivot member 240, and the base 410 can also rotate relative to the pivot member 240. Thus, the base 210 can rotate relative to the base 410 to form required angle variations, and a complicated structure can be constructed.

The modular connection device 100, 200 of the present disclosure can be used to form a variety of supporting skeletons required for furniture equipment, such as sofas, sofa chairs, coffee tables, corner tables, TV cabinets, wine cabinets, decorative cabinets, shoe cabinets, clothing and hat cabinets, bedside tables, dressing tables, hangers, cabinets, dining tables, dining chairs, sideboards, corner cabinets, hand-waste baskets, bookshelves, desks and chairs, file cabinets, umbrella stands, etc. The skeletons even can be used on transportation vehicles (bicycles, motorcycles, automobiles, etc.), doors or windows. Therefore, modular connection device 100, 200 of the present disclosure has wide range of application. Furthermore, each component of the modular connection device 100, 200 can be easily disassembled and assembled, and is convenient and flexible in use.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A modular connection device comprising:

a base comprising a plurality of connection surfaces, wherein each of the connection surfaces is connected with each other;

a plurality of connection members, wherein each of the connection members is detachably connected on each of the connection surfaces; and a pivot member, wherein the pivot member is detachably disposed between the base and another base, the two bases are in close contact with each other and can be rotated parallel to each other via the pivot member;

wherein the pivot member is rotatably disposed between a middle position of one of the connection surfaces of each of the two bases and is hidden between the two connection surfaces when the two bases are pivoted, the connection members connected to the connection surfaces of each of the two bases adjacent to the connection surface in which the pivot member is located are freely rotatable through 360 degrees;

wherein a variable angle is formed between an axis of each of the connection members and each of the connection surfaces.

2. The modular connection device of claim 1, wherein each of the connection surfaces is a planar surface or a curved surface.

3. The modular connection device of claim 1, wherein each of the connection members is detachably inserted into each of the connection surfaces.

4. The modular connection device of claim 1, wherein the angle is greater than 0 degrees and smaller than 180 degrees.

5. The modular connection device of claim 1, wherein each of the connection member is a solid pillar or a hollow pillar.

6. The modular connection device of claim 1, wherein each of the connection member is curve-shaped, straight-shaped or arc-shaped.

7. The modular connection device of claim 1, further comprising a pivot member, wherein the pivot member is detachably disposed between the base and the connection member, and the base and the connection member are rotatable with each other through the pivot member.

8. A modular connection device comprising:

a base comprising a plurality of connection surfaces, wherein each of the connection surfaces is connected with each other;

a plurality of adapting members, wherein each of the adapting members is detachably connected on each of the connection surfaces; and a plurality of connection members, wherein each of the connection members is detachably connected on each of the connection surfaces through each of the adapting members; and a pivot member, wherein the pivot member is detachably disposed between the base and another base, the two bases are in close contact with each other and can be rotated parallel to each other via the pivot member;

wherein the pivot member is rotatably disposed between a middle position of one of the connection surfaces of each of the two bases and is hidden between the two connection surfaces when the two bases are pivoted, the adapting members or the connection members connected to the connection surfaces of each of the two bases adjacent to the connection surface in which the pivot member is located are freely rotatable through 360 degrees:

wherein each of the connection member is curve-shaped, straight-shaped or arc-shaped.

9. The modular connection device of claim 8, wherein each of the connection surfaces is a planar surface or a curved surface.

10. The modular connection device of claim 8, wherein each of the adapting members is detachably inserted to each of the connection surfaces.

11. The modular connection device of claim 8, wherein each of the connection member is covered on each of the adapting member.

12. The modular connection device of claim 8, wherein each of the connection member is a solid pillar or a hollow pillar.

13. The modular connection device of claim 8, wherein each of the adapting member comprises a curved portion.

* * * * *